US007052197B2

(12) United States Patent
Bowen et al.

(10) Patent No.: US 7,052,197 B2
(45) Date of Patent: May 30, 2006

(54) PRINTER SYSTEM HAVING A ROTATABLE INPUT TRAY WITH LENGTH ADJUSTER

(75) Inventors: Mike Bowen, Vancouver, WA (US); Jeffrey Bingham, VanCouver, WA (US); Howard G. Wong, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/720,412

(22) Filed: Nov. 24, 2003

(65) Prior Publication Data

US 2005/0111895 A1 May 26, 2005

(51) Int. Cl.
*B41J 11/58* (2006.01)

(52) U.S. Cl. ..... 400/624; 400/625; 358/498; 271/145

(58) Field of Classification Search ..... 399/377, 399/393, 405; 400/624, 625; 271/145; 221/195; 358/498

See application file for complete search history.

(56) References Cited

U.S. PATENT DOCUMENTS

| | | | | | |
|---|---|---|---|---|---|
| 4,985,714 | A | * | 1/1991 | Norris | 221/195 |
| 5,046,433 | A | * | 9/1991 | Kramer et al. | 108/44 |
| 5,111,252 | A | * | 5/1992 | Hamada et al. | 399/393 |
| 5,454,555 | A | * | 10/1995 | Kiyohara et al. | 271/9.01 |
| 5,511,770 | A | * | 4/1996 | Okazaki | 271/4.01 |
| 5,803,631 | A | | 9/1998 | Bingham et al. | |
| 5,975,520 | A | * | 11/1999 | Shim | 271/171 |
| 5,984,300 | A | * | 11/1999 | Nishiberi | 271/171 |
| 6,009,302 | A | | 12/1999 | Worley et al. | |
| 6,179,499 | B1 | | 1/2001 | Beretta et al. | |
| 6,287,032 | B1 | | 9/2001 | Osmus et al. | |
| 6,296,407 | B1 | | 10/2001 | McKay et al. | |
| 6,406,201 | B1 | | 6/2002 | Beretta et al. | |

* cited by examiner

*Primary Examiner*—Daniel J. Colilla
*Assistant Examiner*—Dave A. Ghatt

(57) ABSTRACT

A printer system including a tray adapted for use with a printing mechanism. The tray includes a stationary portion, a rotatable portion, and a length adjuster. The stationary portion is adapted to be coupled with the print mechanism. The rotatable portion is rotatably coupled with and extends a first length from the stationary portion. The length adjuster is slidably coupled with the rotatable portion and is adapted to move along an adjustable length. The adjustable length is greater than the first length of the rotatable portion.

34 Claims, 15 Drawing Sheets

PRINTER SYSTEM HAVING A ROTATABLE INPUT TRAY WITH LENGTH ADJUSTER

BACKGROUND

Various printing mechanisms, such as photocopiers, laser printers, inkjet printers, etc., typically include trays and/or drawers that temporarily hold a supply of print media sheets for subsequent delivery into the printing mechanism. The trays or drawers, typically referred to as input trays, maintain the print media sheets in a position near a feed mechanism, commonly a pick roller or tire. In particular, the input tray selectively maintains the print media sheets in a position to be contacted or picked by the feed mechanism, which advances the picked print media sheets into the printing mechanism for subsequent printing. Conventional media trays, however, have typically been unable to satisfactorily hold media of different sizes and have small footprints.

BRIEF DESCRIPTION OF THE DRAWINGS

Example embodiments of the invention are illustrated in the following drawings. The elements of the drawings are not necessarily to scale relative to each other. Like reference numerals designate corresponding similar parts.

DESCRIPTION OF THE EXAMPLE EMBODIMENTS

Figure 1:
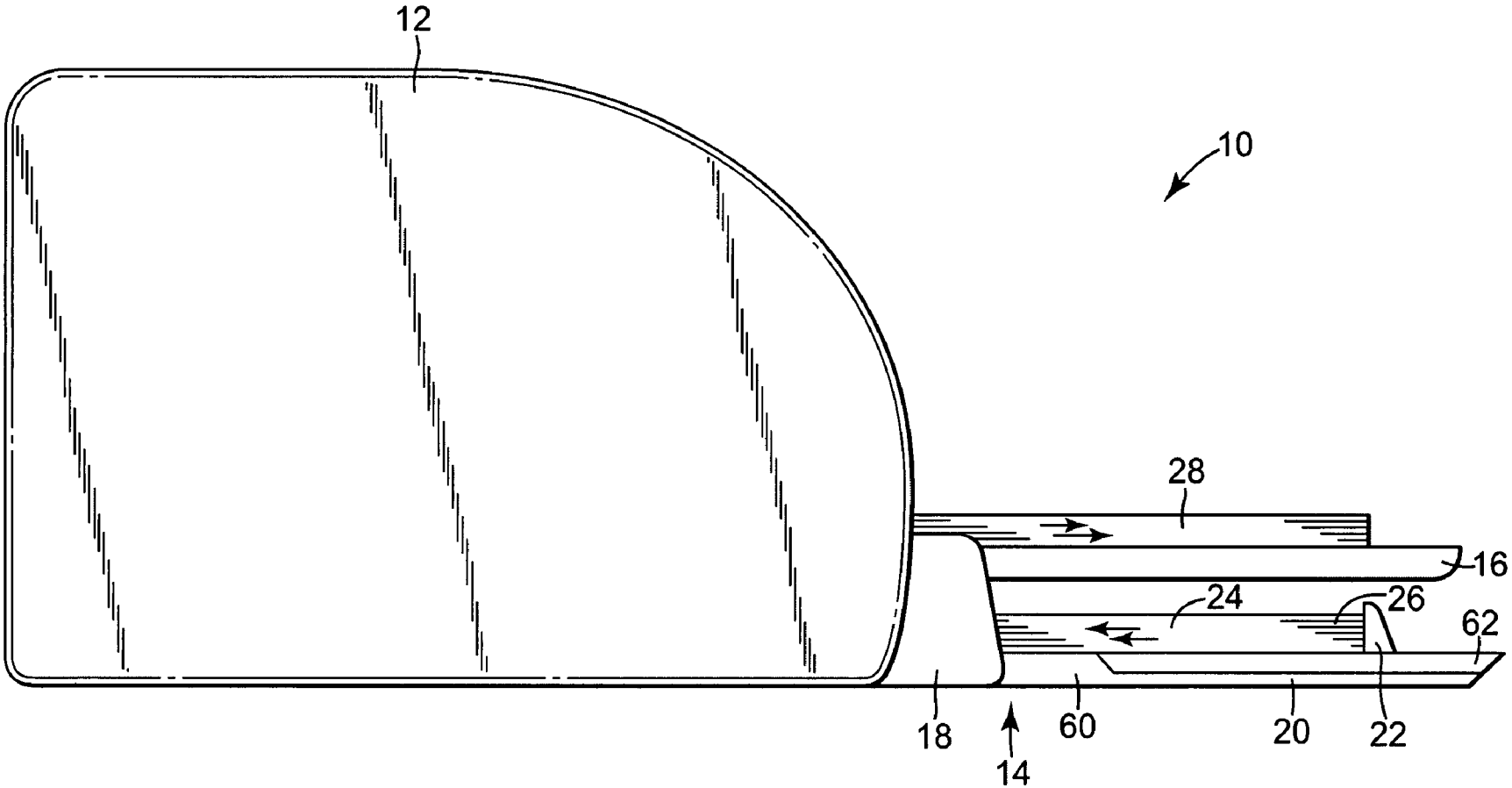
FIG. 1 illustrates a side view of one embodiment of a printing mechanism incorporating one embodiment of a rotatable media input tray.

FIG. 1 illustrates one exemplary embodiment of a printing mechanism generally at 10. Printing mechanism 10 includes a main chassis 12, an input tray 14, and an output tray 16. Main chassis 12 houses the feed mechanism and printing components for advancing and printing upon print media. Input tray 14 is coupled with main chassis 12. The input tray 14 according to example embodiments includes a length adjuster having an extended adjustable length. In particular, input tray 14 includes a stationary portion 18, a rotatable portion 20, and a length adjuster 22. The length adjuster 22 is adapted to move along an adjustable length, the adjustable length being greater than the rotatable portion 20. The relatively large range of length adjuster movement allows the input tray 14 to receive a large variety of print media sizes. In one embodiment, the length adjuster 22 is adapted to facilitate reception of media sheets having a length ranging from 5 to 14 inches, although these dimensions may vary.

Stationary portion 18 is coupled with and at least partially maintained within main chassis 12. Rotatable portion 20 is selectively coupled with stationary portion 18 opposite main chassis 12. When positioned for use, rotatable portion 20 extends from stationary portion 18 in a substantially horizontal manner, such that stationary portion 18 and rotatable portion 20 each at least partially maintain an input media stack 24. Input media stack 24 includes a plurality of print media sheets of any type of suitable sheet material, such as paper, cardstock, transparencies, Mylar, and the like. Length adjuster 22 is slidably mounted upon input tray 14 and adjusts to abut with a trailing edge 26 of print media stack 24.

In one embodiment, output tray 16 is rotatably connected to stationary portion 18 of input tray 14. In particular, output tray 16 is rotatably connected to stationary portion 18 above rotatable portion 20. When in the position for use, output tray 16 extends in a substantially horizontal manner, i.e., substantially parallel to rotatable portion 20. Upon use of printing mechanism 10, print media sheets are pulled from the top of input media stack 24, fed into main chassis 12, are printed or recorded upon, and expelled onto output tray 16, thereby, forming an output media stack 28.

Figure 2:
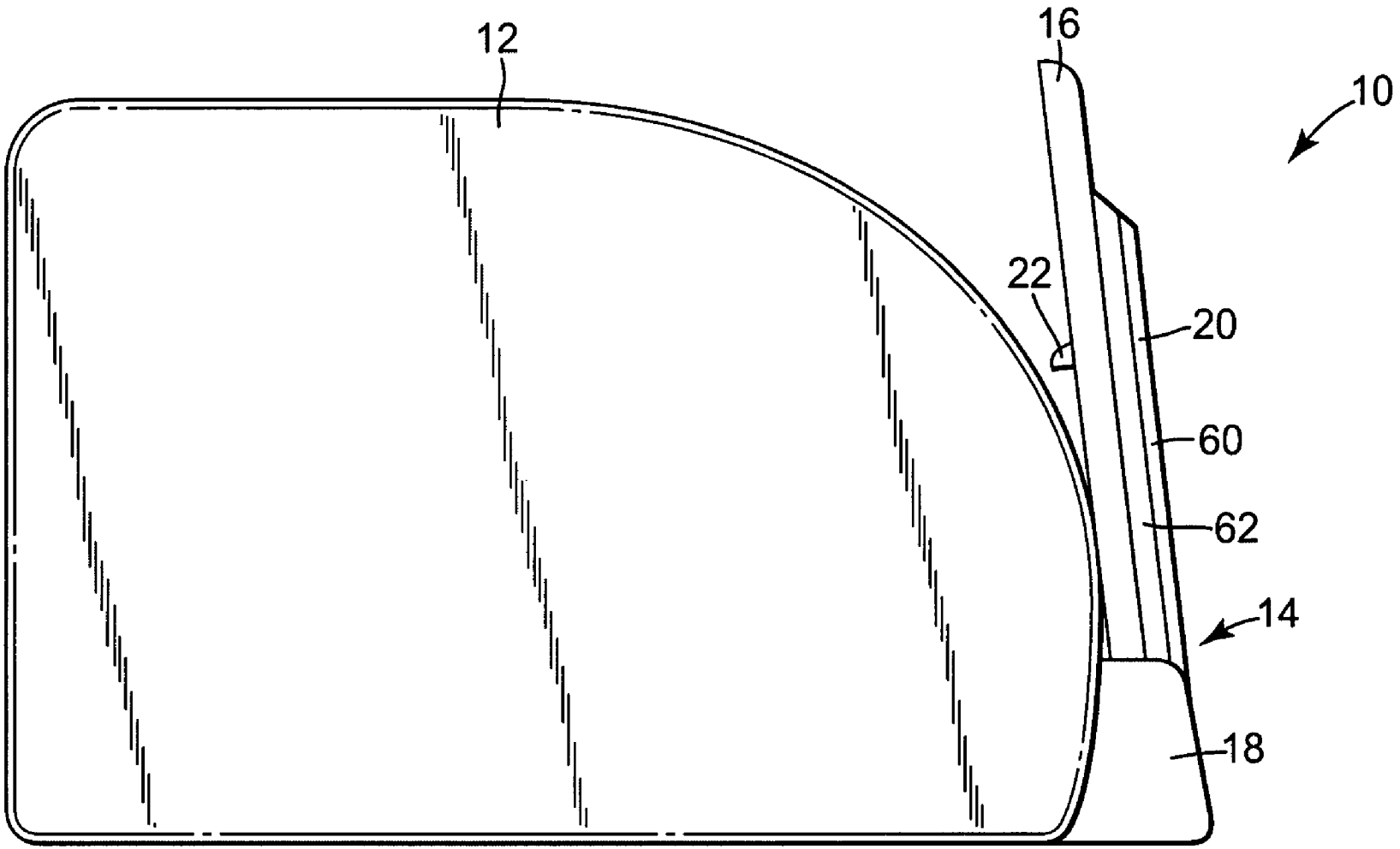
FIG. 2 illustrates a side view of one embodiment of the printing mechanism of FIG. 1 with the rotatable media input tray in a storage position.

Following use or between uses of printing mechanism 10, printing mechanism 10 transitions into a storage position as illustrated in FIG. 2. Following use or between uses, input media stack 24 and/or output media stack 28 are removed from input tray 14 and output tray 16, respectively. Output tray 16 is rotated about its hinged connection with stationary portion 18 toward main chassis 12 and into a relatively vertical position. In one embodiment, output tray 16 folds into a position approximately 10° or less from a true vertical position. Following rotation of output tray 16 into the storage position, rotatable portion 20 similarly rotates about its connection with stationary portion 18 into a substantially vertical position. In one embodiment, rotatable portion 20 rotates about stationary portion 18 until rotatable portion 20 abuts output tray 16 in the storage position. In one embodiment, output tray 16 includes at least one aperture (not illustrated) to receive length adjuster 22 in the storage position. Notably, when placed in the storage position, printing mechanism 10 requires a substantially smaller footprint of a desk, table, or other supporting surface to support printing mechanism 10.

Figure 3:
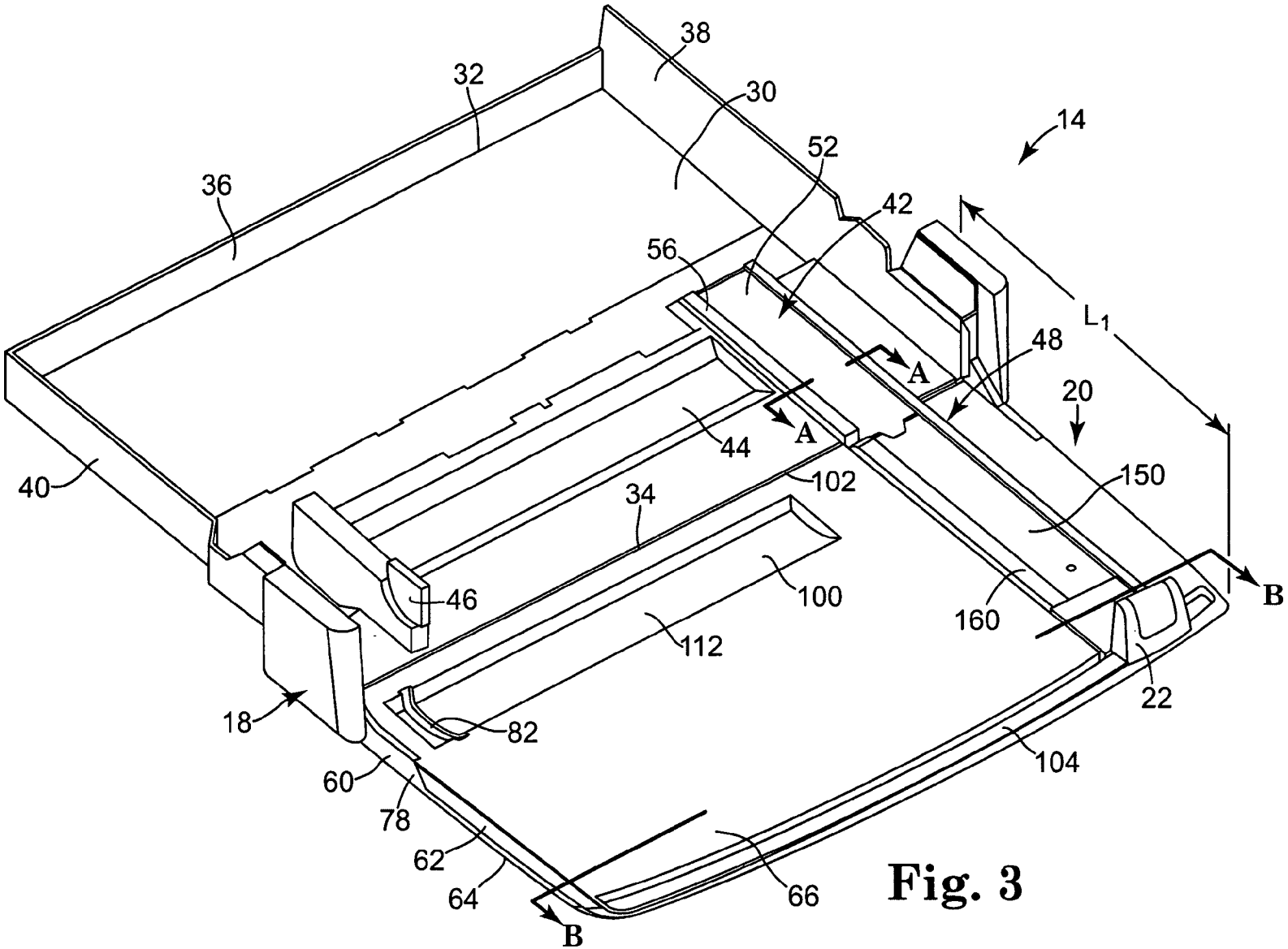
FIG. 3 illustrates a perspective view of one embodiment of the rotatable media input tray of FIG. 1 in a nominal use position.

One embodiment of input tray 14 is generally illustrated in FIG. 3. In one embodiment, stationary portion 18 defines an interior surface 30, a leading edge 32, and a trailing edge 34. In one embodiment, stationary portion 18 includes a side wall 36 along leading edge 32, and side walls 38 and 40 extending from opposite ends of side wall 36 towards trailing edge 34 of stationary portion 18. Side walls 36, 38, and 40 each extend upwardly from interior surface 40.

In one embodiment, stationary portion 18 further includes a stationary track portion 42, a width adjuster track 44, and a media width adjuster 46. Stationary track portion 42 is attached to or defined by interior surface 30. Stationary track portion 42 is part of a length adjuster track 48 for selectively maintaining and guiding length adjuster 22. Stationary track portion 42 extends from and perpendicular to trailing edge 34 towards leading edge 32 of stationary portion 18. Stationary track portion 42 is adapted to selectively and slidably receive length adjuster 22.

Figure 3A:
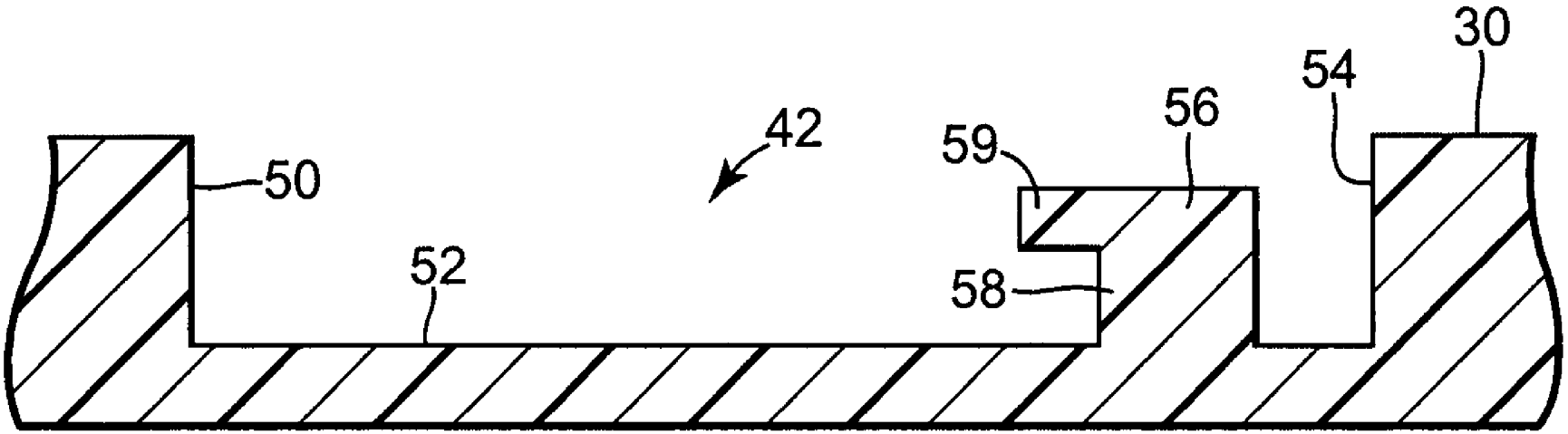
FIG. 3A illustrates a cross-sectional view of the rotatable media input tray of FIG. 3 taken about the line A—A.

As illustrated in the cross-section of FIG. 3A, one embodiment of stationary track portion 42 defines a first side surface 50, a base surface 52, and a second side surface 54. First side surface 50 is positioned relatively near first side wall 36 and extends downwardly from interior surface 30 in a substantially perpendicular manner. Base surface 52 extends in a substantially perpendicular manner from first side surface 50 opposite interior surface 30. As such, base surface 52 is substantially offset and parallel to interior surface 30. Second side surface 54 extends upwardly from base surface 52 opposite first side surface 50 with a substantially perpendicular orientation with respect to base surface 52.

In one embodiment, stationary track portion 42 includes an interior track rail 56. Interior track rail 56 is spaced from and extends in a substantially parallel manner to first and second side surfaces 50 and 54. In one embodiment, interior track rail 56 is positioned relatively nearer second side surface 54 than first side surface 50. Interior track rail 56 includes a leg 58 and a flange 59. Leg 58 extends upwardly from base surface 52 in a substantially perpendicular fashion. Flange 59 extends from leg 58 in a substantially perpendicular manner towards first side surface 50.

Width adjuster track 44 is also connected to or defined by interior surface 30. Width adjuster track 44 extends substantially parallel to leading edge 32. Media width adjuster 46 is slidably coupled to width adjuster track 44, such that media width adjuster 46 selectively slides along width adjuster track 44 in a direction substantially parallel with leading edge 32. Upon insertion of input media stack 24 (illustrated in FIG. 1) into input tray 14, media stack 24 is aligned with side walls 36 and 38. Media width adjuster 46 is slidably adjusted within width adjuster track 44 to interact with input media stack 24 opposite side wall 38.

Figure 3B:
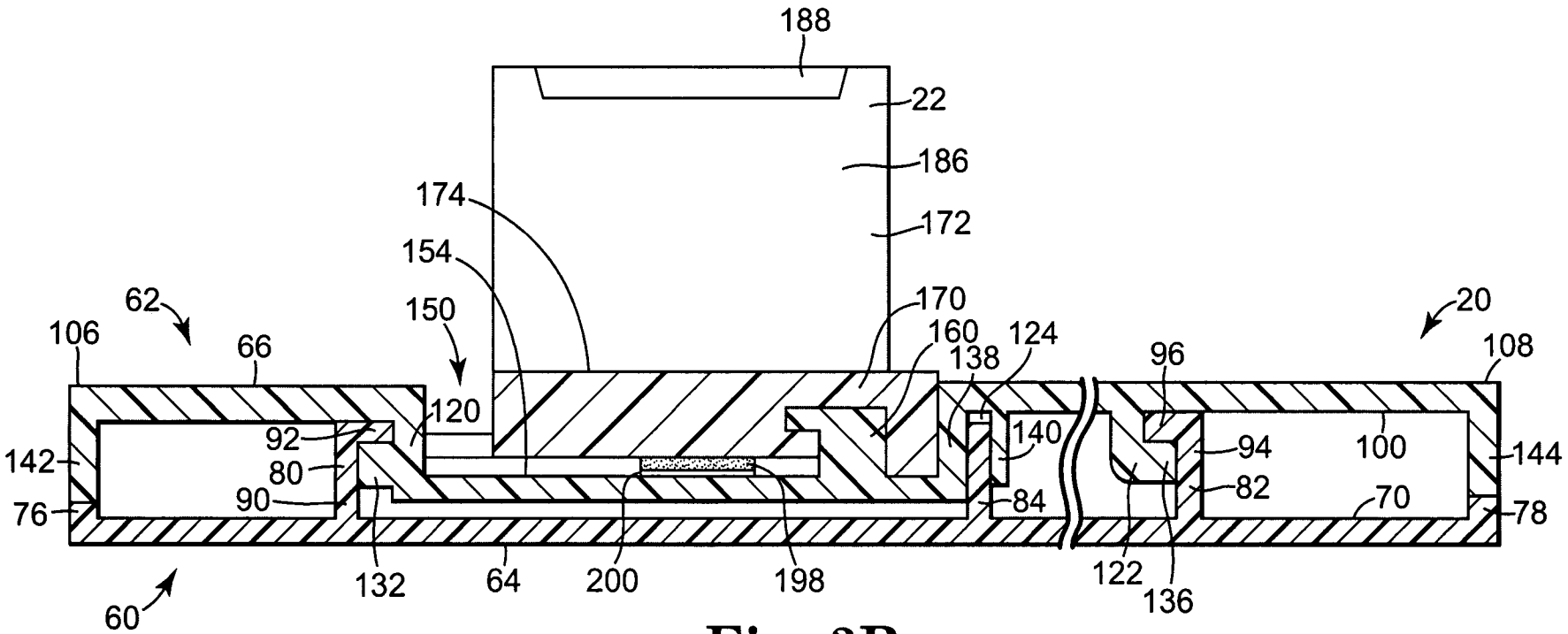
FIG. 3B illustrates a cross-sectional view of the rotatable media input tray of FIG. 3 taken about the line B—B.

Rotatable portion 20 is rotatably connected to stationary portion 18 near trailing edge 34. Rotatable portion 20 includes a primary section 60 and an extension section 62. Primary section 60 is rotatably connected to stationary portion 18. In one embodiment, primary section 60 is rotatably coupled with stationary portion 18 via at least one rotatable snap connection, hinge, or other device or mechanism providing a rotatable connection. In one embodiment, extension section 62 is slidably coupled with primary section 60 as illustrated in the cross-section of FIG. 3B. In particular, primary section 60 and extension section 62 are slidably attached such that when rotatable portion 20 is in a nominal position, as illustrated in FIG. 3, an exterior surface 64 of primary section 60 also serves as an exterior surface of rotatable portion 20. Likewise, while in the nominal position, an interior surface 66 of extension section 62 serves as the interior surface of rotatable portion 20 adapted to interact with input media stack 24 (illustrated in FIG. 1). Primary section 60 and extension section 62 have a similar shape and similar outer dimensions and function as an integral rotatable portion 20 when in the nominal position.

Figure 4:
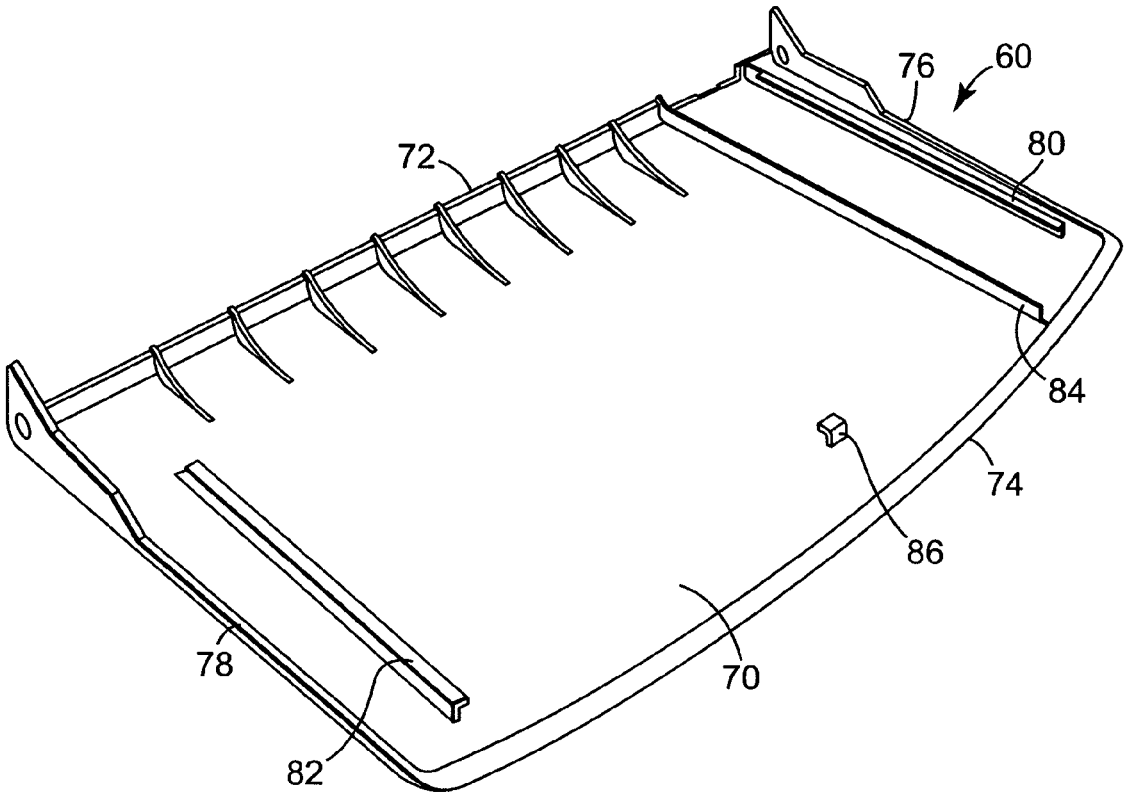
FIG. 4 illustrates a perspective view of one embodiment of a primary section of the rotatable media input tray of FIG. 3.

Referring to FIG. 4, primary section 60 further defines an interior surface 70, a leading edge 72, a trailing edge 74, a first side edge 76, and a second side edge 78. Interior surface 70 is opposite exterior surface 64 of primary section 60. Leading edge 72 is proximately located with respect to stationary portion 18 of input tray 14 (illustrated in FIG. 3). Trailing edge 74 is opposite leading edge 72, and interior surface 70 is further flanked by first side edge 76 and second side edge 78, which is opposite first side edge 76. Primary section 60 includes a first guide rail 80, a second guide rail 82, a third guide rail 84, and a latch 86. First, second, and third guide rails 80, 82, and 84 extend upwardly from interior surface 70 and run substantially perpendicular to leading edge 72. In one embodiment, first guide rail 80 is located relatively near first side edge 76 and second guide rail 82 is located relatively near second side edge 78. Third guide rail 84 is located between first guide rail 80 and second guide rail 82. In one embodiment, third guide rail 84 is located substantially nearer first guide rail 80 than second guide rail 82. Each of first, second, and third guide rails 80, 82, and 84 are adapted to facilitate the slideable coupling of primary section 60 with extension section 62, as illustrated in the cross-section of FIG. 3B.

Figure 4A:
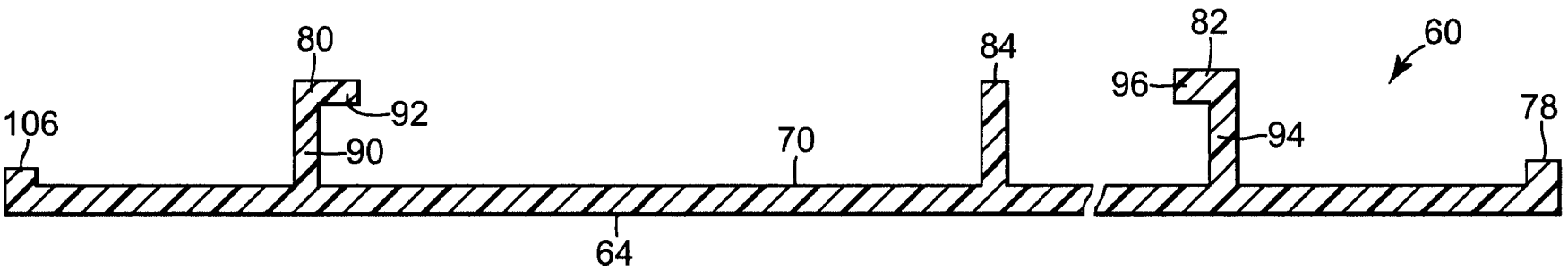
FIG. 4A illustrates a portion of the cross-sectional view of FIG. 3B isolating the primary section of FIG. 4.

Referring to the isolated cross-section of primary section 60, illustrated in FIG. 4A, first guide rail 80 includes a leg 90 and a flange 92. Leg 90 extends upwardly from interior surface 70 with a substantially perpendicular orientation. In one embodiment, leg 90 runs from leading edge 72 towards trailing edge 74 (illustrated in FIG. 4), traversing a majority of the distance between leading edge 72 and trailing edge 74. Flange 92 extends from leg 90 opposite interior surface 70. In particular, flange 92 extends from leg 90 with a substantially perpendicular orientation towards second guide rail 82.

Second guide rail 82 runs across a substantial portion of the distance between leading edge 72 and trailing edge 74. Second guide rail 82 includes a leg 94 and a flange 96 similar to the leg 90 and flange 92 of first guide rail 80. However, second guide rail 82 is positioned such that flange 96 extends from leg 94 towards first guide rail 80. Third guide rail 84 extends from interior surface 70 in a substantially perpendicular manner and runs a substantial portion of the distance between leading edge 72 and trailing edge 74.

In one embodiment, latch 86 (illustrated in FIG. 4) is substantially centered between first side edge 76 and second side edge 78. In one embodiment, latch 86 extends upwardly from interior surface 70 in a hook-like manner toward trailing edge 74. In one embodiment, latch 86 is positioned relatively near trailing edge 74. Latch 86 is designed to limit the movement of extension section 62 with respect to primary section 60.

Figure 5:
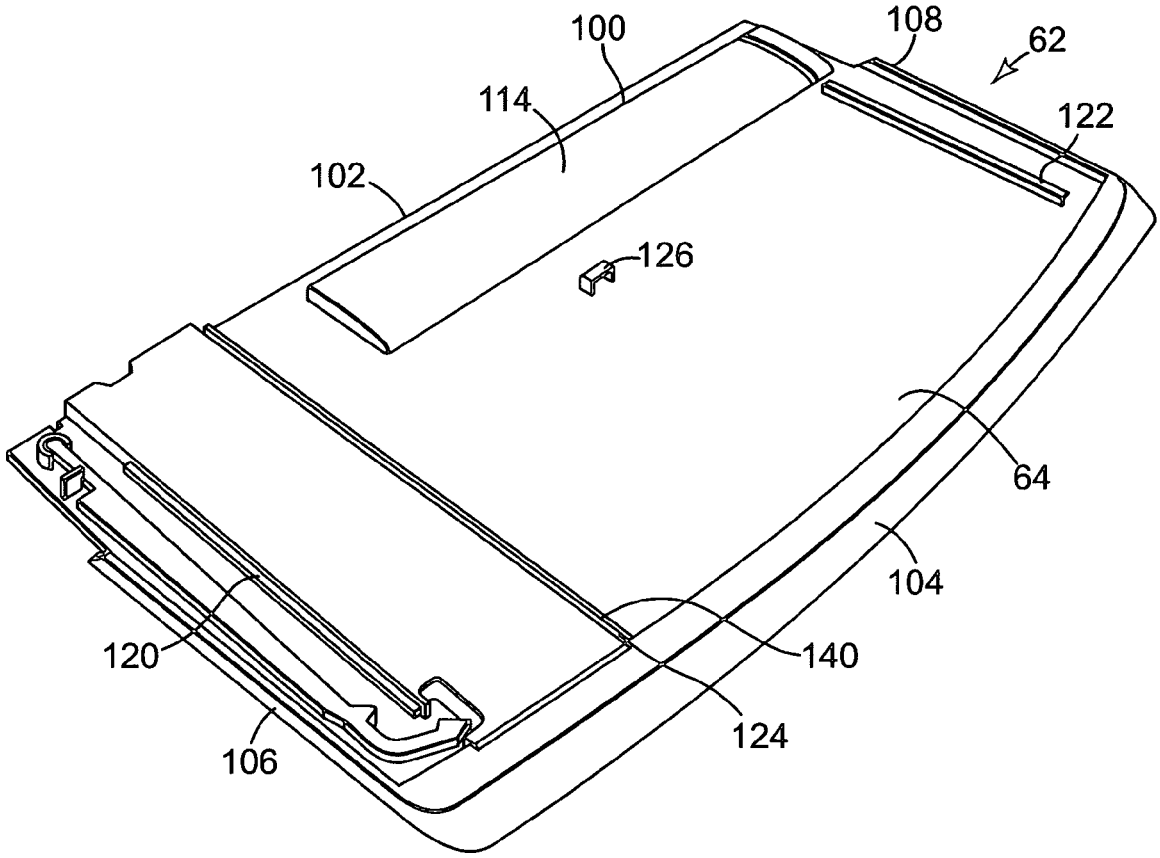
FIG. 5 illustrates a perspective view of one embodiment of an exterior surface of an extension section of the rotatable media input tray of FIG. 3.
Figure 5A:
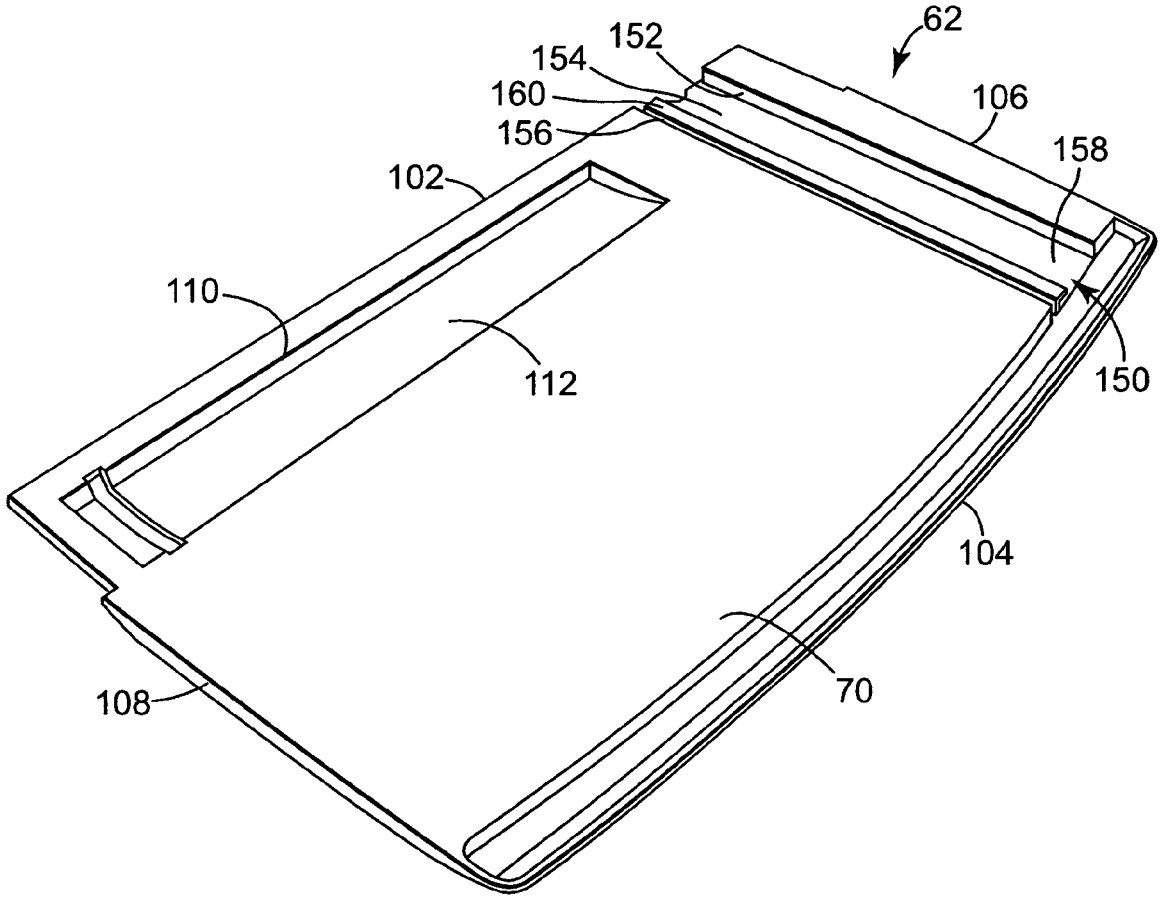
FIG. 5A illustrates a perspective view of one embodiment of an interior surface of the extension section of the rotatable media input tray of FIG. 3.

One embodiment of extension section 62 is generally illustrated in FIGS. 5 and 5A. Extension section 62 includes an exterior surface 100 opposite interior surface 66, a leading edge 102, a trailing edge 104, a first side edge 106, and a second side edge 108. Leading edge 102 is located relatively near stationary portion 18 of input tray 14 and opposite trailing edge 104 (illustrated in FIG. 3). First and second side edges 106 and 108 run from leading edge 102 to trailing edge 104 with second side edge 108 positioned opposite first side edge 106. More particularly, side edges 106 and 108 extend substantially perpendicular to leading edge 102.

In one embodiment, extension section 62 further includes a recessed portion 110. Recessed portion 110 extends substantially parallel to leading edge 102 and is indented toward exterior surface 100. In particular, an interior surface 112 of recessed portion 110 is offset from interior surface 66 towards exterior surface 100. Accordingly, an exterior surface 114 of recessed portion 110 is offset below exterior surface 100. The size and position of recessed portion 110 increases the rigidity of extension section 62 and, in one embodiment, is an additional support between primary section 60 and extension section 62.

Figure 5B:
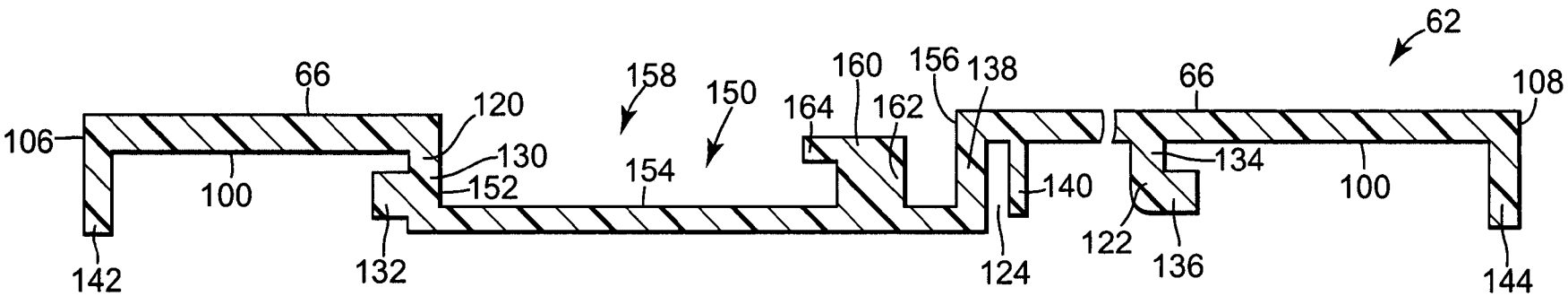
FIG. 5B illustrates a portion of the cross-sectional view of FIG. 3B isolating the extension section illustrated in FIGS. 5 and 5A.

In one embodiment, extension section 62 includes or defines a first connection rail 120, a second connection rail 122, a connection groove 124, and a latch stop 126. As illustrated in FIG. 5B, first and second connection rails 120 and 122 and connection groove 124 extend downwardly from exterior surface 100 and run substantially perpendicular to leading edge 102. In one embodiment, first connection rail 120 is positioned relatively near first side edge 106, and second connection rail 122 is positioned relatively near second side edge 108. Connection groove 124 is positioned between first connection rail 120 and second connection rail 122. In one embodiment, connection groove 124 is positioned relatively near first connection rail 120 as compared to second connection rail 122.

In one embodiment, first connection rail 120 includes a leg 130 and a tab 132. Leg 130 extends downwardly from exterior surface 100. Tab 132 extends from leg 130 opposite exterior surface 100 in a substantially perpendicular manner. In particular, tab 132 extends toward first side edge 106. In one embodiment, second connection rail 122 includes a leg 134 and a tab 136 in a similar manner as described with respect to first connection rail 120, leg 130, and tab 132. Leg 134 extends downwardly from exterior surface 100 in a substantially perpendicular manner. Tab 136 extends from leg 134 opposite exterior surface 100 in a substantially perpendicular direction towards second side edge 108. Notably, first connection rail 120 and second connection rail 122 are configured to interact with first guide rail 80 and second guide rail 82 of primary section 60, respectively.

Connection groove 124 is defined by a first leg 138 and a second leg 140, spaced from first leg 138. Each leg 138 and 140 extend downwardly from exterior surface 100 in a substantially perpendicular manner. In one embodiment, leg 138 is nearer first connection rail 120 than is leg 140. As such, connection groove 124 is defined by leg 138, leg 140, and exterior surface 100. Notably, in one embodiment, legs 138 and 140 are spaced such that third guide rail 84 fits snugly, yet slidably, between legs 138 and 140.

Latch stop 126 extends downwardly from exterior surface 100. In one embodiment, latch stop 126 is substantially centered between first side edge 106 and second side edge 108. In one embodiment, latch stop 126 is positioned relatively near leading edge 102 with respect to trailing edge 104. Latch stop 126 is adapted to interact with latch 86 to facilitate maintenance of the connection between primary section 60 and extension section 62. In one embodiment, extension section 62 further includes a first side wall 142 and a second side wall 144. First side wall 142 extends downwardly from first side edge 106, and similarly, second side wall 144 extends downwardly from exterior surface 100 at second side edge 108. First and second side walls 142 and 144 are configured to interact with first side edge 76 and second side edge 78 of primary section 60, respectively.

Extension section 62 defines, by including or forming, a rotatable track portion 150 of length adjuster track 48, as illustrated in FIGS. 5–5B. Rotatable track portion 150 runs substantially perpendicular to leading edge 102. In one embodiment, rotatable track portion 150 is positioned relatively nearer first side edge 106 than second side edge 108. Rotatable track portion 150 defines a first side surface 152, a base surface 154, and second side surface 156. First side surface 152 extends downwardly from interior surface 66 in a substantially perpendicular manner. Base surface 154 extends from first side surface 152 opposite interior surface 66. In one embodiment, base surface 154 extends from first side surface 152 in a substantially perpendicular manner toward second side edge 108; Second side surface 156 extends upwardly from base surface 154 in a substantially perpendicular manner to interior surface 66. As such, first side surface 152, base surface 154, and second side surface 156 combine to form a groove or track indentation 158, in which base surface 154 is offset from interior surface 66. In one embodiment, rotatable track portion 150 is positioned on extension section 62 between first connection rail 120 and connection groove 124. In one embodiment, first side surface 152 is formed from leg 130 of first connection rail 120, first side surface 152 being opposite tab 132. In one embodiment, second side surface 156 is formed from first leg 138 of connection groove 124. In particular, first side surface 156 is on the opposite side of leg 38 as is connection groove 124.

In one embodiment, rotatable track portion 150 further includes an internal track rail 160. Internal track rail 160 runs substantially parallel with first and second side surfaces 152 and 156. In one embodiment, internal track rail 160 is spaced from but located substantially nearer first side surface 152 than second side surface 156. Internal track rail 160 includes a leg 162 and a flange 164. Leg 162 extends upwardly from interior surface 66 in a substantially perpendicular manner and parallel with first and second side surfaces 152 and 156. Flange 164 extends from leg 162 opposite interior surface 66 in a substantially perpendicular manner. In one embodiment, flange 164 extends from leg 162 toward first side surface 152. As such, flange 164 extends parallel and spaced from interior surface 66. Notably, rotatable track portion 150 is adapted to slidably receive length adjuster 22.

Figure 6:
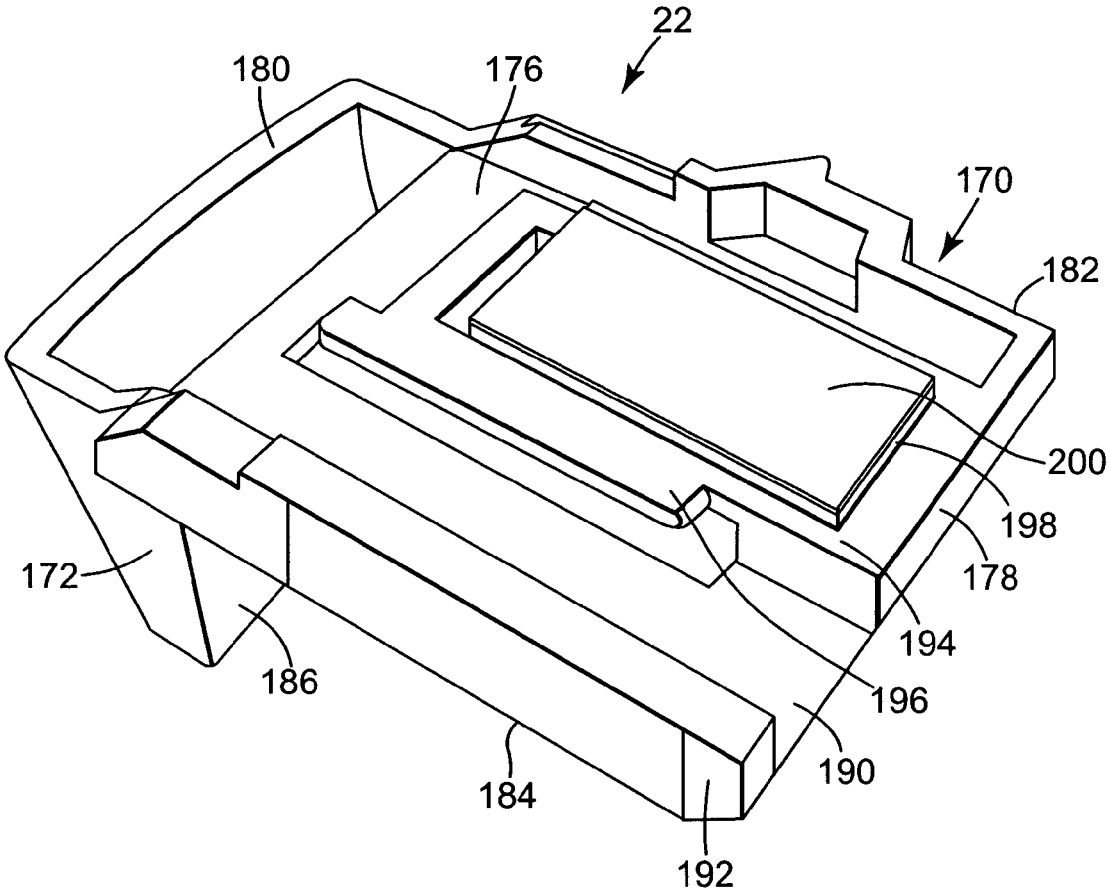
FIG. 6 illustrates a perspective view of one embodiment of a length adjuster of the rotatable media input tray of FIG. 3.
Figure 6A:
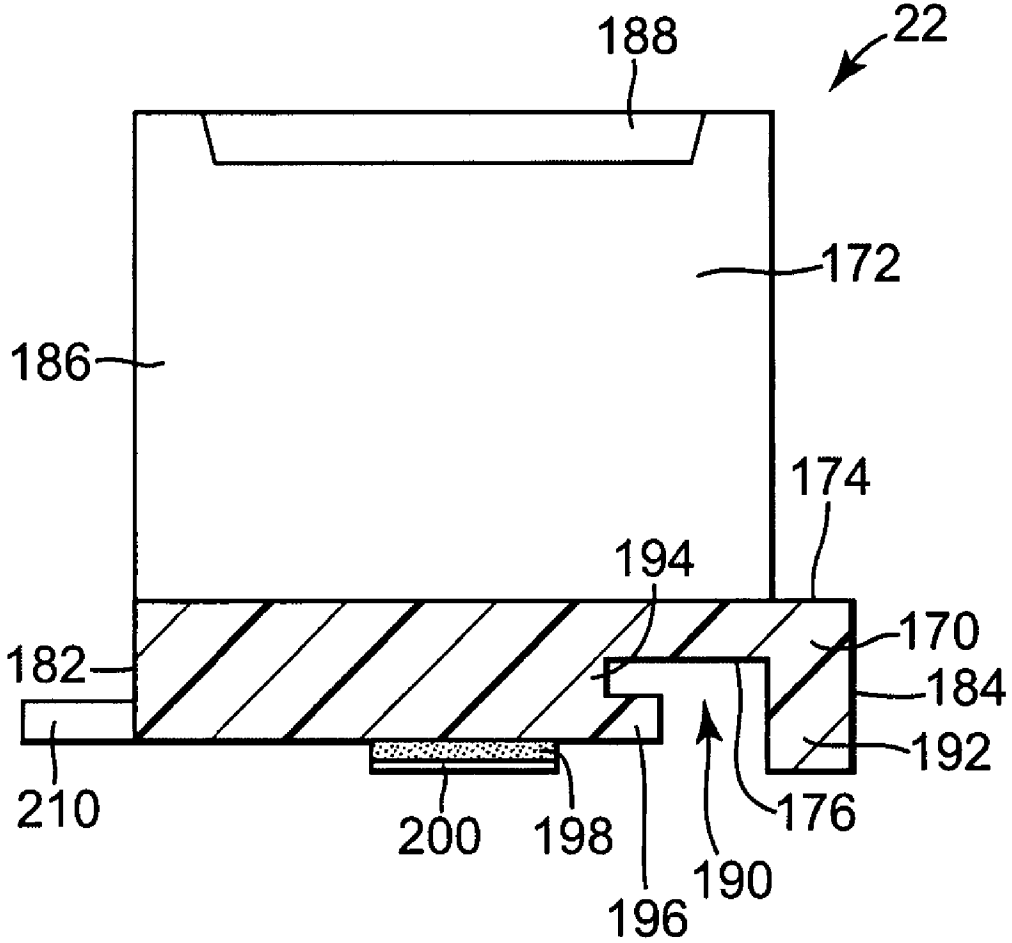
FIG. 6A illustrates a portion of the cross-sectional view of FIG. 3B isolating the length adjuster of FIG. 7.

FIG. 6 and the cross-section of FIG. 6A generally illustrate one embodiment of length adjuster 22. Length adjuster 22 includes a track interface portion 170 and a media stop or handle 172. Track interface portion 170 defines a first surface 174, a second surface 176 opposite first surface 174, a leading edge 178, a trailing edge 180, a first side edge 182, and a second side edge 184. Leading edge 178 and trailing edge 180 are located opposite each other with respect to track interface portion 170. First and second side edges 182 and 184 run between leading edge 178 and trailing edge 180 and flank the remaining sides of track interface portion 170. Media stop 172 extends from trailing edge 180 of first surface 174 in an upward direction, i.e in a direction away from second surface 176. Media stop 172 defines a media interface surface 186 on a side relatively near leading edge 178. Media interface surface 186 is substantially flat in order to interact with input media stack 24 (illustrated in FIG. 1). In one embodiment, media stop 172 further includes a grip area 188 to facilitate a user's interaction with length adjuster 22.

Track interface portion 170 further defines a track reception groove 190. In particular, track interface portion 170 includes a first leg 192, a second leg 194, and a tab 196. First leg 192 extends downwardly from second surface 176 in a substantially perpendicular manner. In one embodiment, first leg 192 extends downwardly from second side edge 184. Second leg 194 extends downwardly from second surface 176 in a substantially perpendicular manner. In one embodiment, second leg 194 is spaced between first side edge 182 and second side edge 184. In one embodiment, second leg 194 is positioned substantially nearer second side edge 184 than first side edge 182. Tab 196 extends from second leg 194 opposite second surface 176. In particular, tab 196 extends from second leg 194 in a substantially perpendicular manner toward first leg 192. As such, tab 196 is spaced from and extends toward first leg 192. Notably, track reception groove 190 is defined to interact with internal track rail 160.

In one embodiment, track interface portion 170 further defines additional legs or tabs to further strengthen length adjuster 22. In one embodiment, length adjuster 22 further includes a cushioning member 198. Cushioning member 198 is coupled with second surface 176. Cushioning member 198 is positioned to extend downwardly from second surface 176. In one embodiment, cushioning member 198 extends further downward than first or second legs 192 and 194. In one embodiment, cushioning member 198 is formed of a substantially resilient member designed to cushion and facilitate relatively smooth movement of length adjuster 22 within length adjuster track 48. In one embodiment, cushioning member 198 further includes a low friction sheet 200. Low friction sheet 200 is connected to and covers the bottom portion of cushioning member 198 to facilitate ease of movement of length adjuster 22 within length adjuster track 48 by decreasing the friction losses between length adjuster 22 and base surfaces 52 and 154 of length adjuster track 48. In one embodiment, cushioning member 198 is a compressible form pad formed from poron. In one embodiment, low friction sheet 200 is a slip pad formed of ultra high molecular weight polyethylene (UHMWPE).

Upon assembly, extension section 62 is slidably received by primary section 60. In particular, referring to FIG. 3A, extension section 62 is aligned with primary section 60 such that first and second side edges 76 and 78 of primary section 60 align with first and second side walls 142 and 144 of extension section 62, respectively. Also upon proper alignment, first connection rail 120, second connection rail 122, and connection groove 124 of extension section 62 align with first guide rail 80, second guide rail 82, and third guide rail 84 of primary section 60, respectively. In particular, flange 92 of first guide rail 80 is received between tab 132 of first connection rail 120 and exterior surface 100. Flange 96 of second guide rail 82 is received between tab 136 of second connection rail 122 and exterior surface 100. In addition, third guide rail 84 is received by connection groove 124, i.e. between first leg 138 and second leg 140.

Upon proper alignment, extension section 62 is slid along guide rails 80, 82, and 84 and on to primary section 60. Notably, the configuration and interaction of guide rails 80, 82, and 84 and connection rails 120 and 122 as well as connection groove 124 allows for selective and slidable interaction between primary section 60 and extension section 62 while simultaneously limiting movement in the direction opposite the orientation of guide rails 80, 82, and 84. Assembly of extension section 62 to primary section 60 completes assembly of rotatable portion 20 of input tray 14.

Length adjuster 22 is received by extension section 62. In particular, length adjuster 22 is aligned with rotatable track portion 150 such that track reception groove 190 is aligned with internal track rail 160. Upon alignment, flange 164 of internal track rail 160 is received between tab 196 and second surface 176 of length adjuster 22. As such, length adjuster 22 is slid upon internal track rail 160 and onto rotatable track portion 150. Upon assembly of one embodiment, cushioning member 198, and more particularly low friction sheet 200, of input finger 22 interacts with base surface 154 of rotatable track portion 150. Interaction between length adjuster 22 and extension section 62 allows length adjuster 22 to slide substantially smoothly and selectively along rotatable track portion 150.

Upon assembly of rotatable portion 20 with length adjuster 22, rotatable portion 20 is rotatably coupled with stationary portion 18. In particular, primary section 60 is rotatably attached to stationary portion 18 such that leading edge 72 of primary section 60 is adjacent to trailing edge 26 of stationary portion 18. Furthermore, upon assembly, rotatable track portion 150 is aligned with stationary track portion 42. Proper alignment of rotatable track portion 150 and stationary track portion 42 allows length adjuster 22 to slidably translate between and along both the rotatable track portion 150 and stationary track portion 42, as illustrated in FIG. 3.

Figure 7:
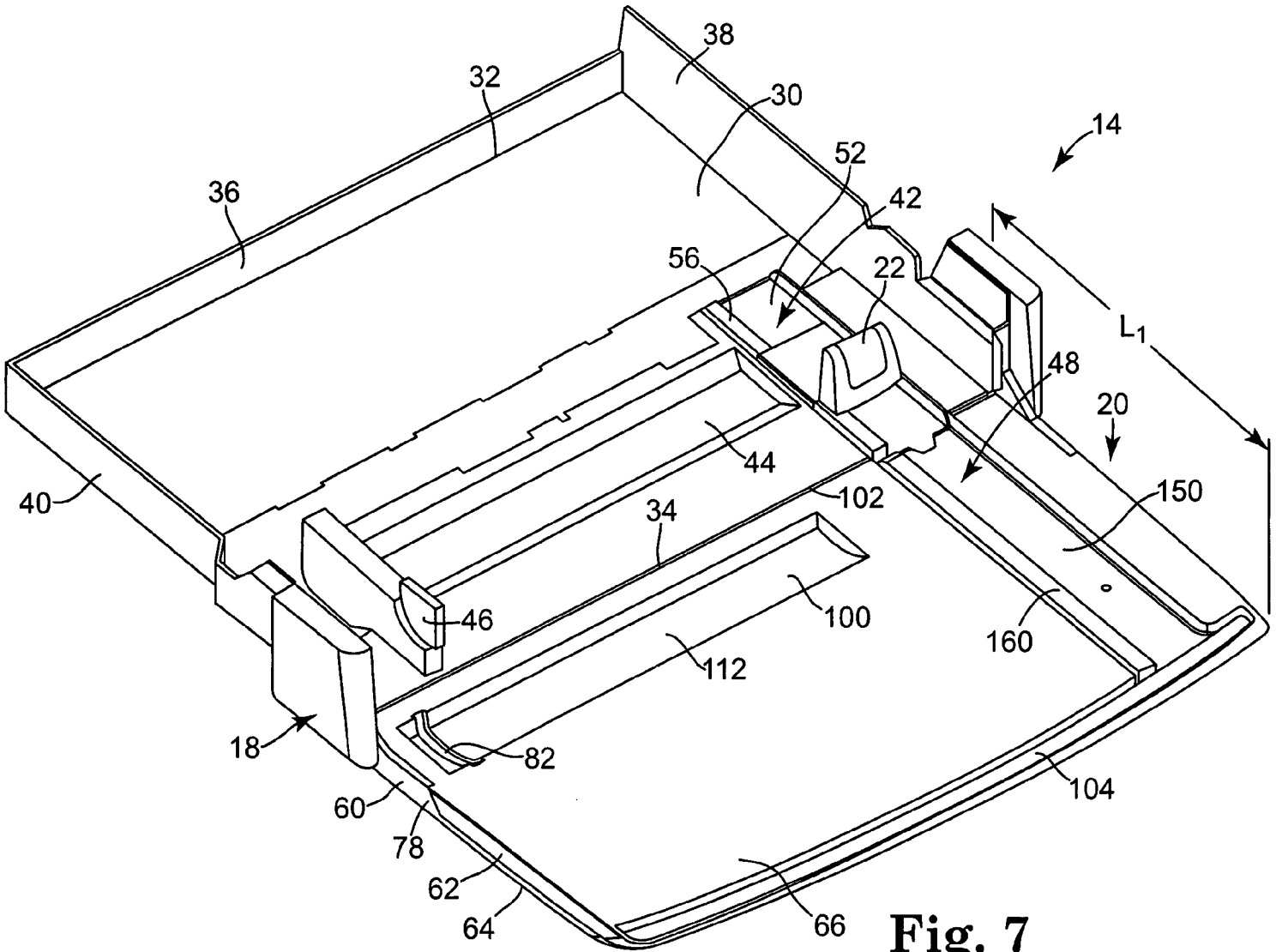
FIG. 7 illustrates a perspective view of one embodiment of the rotatable media input tray illustrated in FIG. 3 in a nominal position.

Continuing to refer to FIGS. 3 and 7, input tray 14 is illustrated in a nominal position. While in the nominal position, leading edge 102 of extension section 62 is substantially aligned with leading edge 72 of primary section 60. In one embodiment, the nominal position also substantially aligns trailing edge 104 of extension section 62 with trailing edge 74 of primary section 60. As such when in the nominal position, rotatable portion 20 extends a first length $L_1$ from stationary portion 20. In the nominal position, length adjuster 22 is free to move along and between rotatable track portion 150 and stationary track portion 42. Length adjuster 22 is adjusted according to the length of input media stack 24 (illustrated in FIG. 1). In particular, media interface surface 186 of length adjuster 22 is positioned a distance from leading edge 32 of stationary portion 18 substantially equal to the length of input media stack 24. As such, for a shorter media input media stack 24, such as for index card or other relatively small media, length adjuster 22 will be positioned upon stationary track portion 42, as illustrated in FIG. 7. In particular, surfaces 50, 52, and 54 (illustrated in FIG. 3A) of stationary track portion 42 are aligned with surfaces 152, 154, and 156 (illustrated in FIG. 3B) of rotatable track portion 150. In one embodiment, internal track rail 56 of stationary track portion 42 aligns with internal track rail 160 of rotatable track portion 150.

In one embodiment, length adjuster track 48 allows length adjuster 22 to be adjusted to interact with print media having a length less than 6 inches and, in one embodiment with print media have a length as little as 5 inches. Accordingly, for longer input media stacks 24, such as for media stacks having letter-sized or A4-sized media, length adjuster 22 will be positioned upon rotatable track portion 150, as illustrated in FIG. 3. In particular, length adjuster 22 interacts with surfaces 50, 52, and 54 of stationary track portion 42 in a similar manner as described above with respect to surfaces 152, 154, and 156 of rotatable track portion 150. In one embodiment, length adjuster 22 interacts with internal track rail 56 of stationary track portion 42 in a similar manner as described above with respect to internal track rail 160 of rotatable track portion 150.

Figure 8:
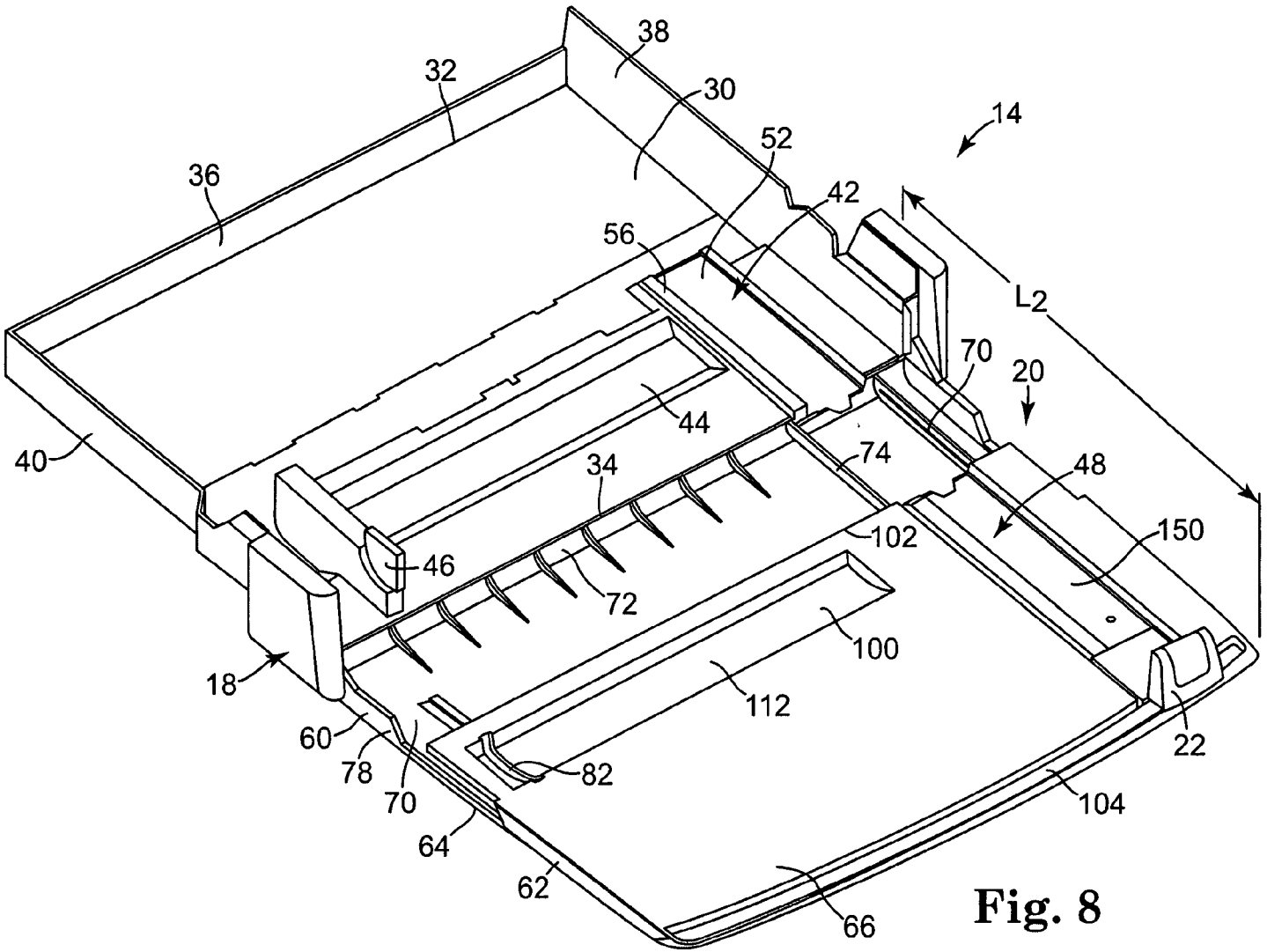
FIG. 8 illustrates a perspective view of one embodiment of the rotatable media input tray illustrated in FIG. 3 in an extended position.

However, in some circumstances movement of length adjuster to trailing edge 104 of extension section 62 does not position media interface surface 186 a sufficient distance away from leading edge 32 of stationary portion 18 of input tray 14 to interact with a relatively long media stack 24. In such instances, extension section 62 is slid upon guide rails 80, 82, and 84 away from leading edge 72 of primary section 60, as illustrated in FIG. 8. By sliding extension section 62 upon primary section 60 the distance between media interface surface 186 of length adjuster 22 and leading edge 32 of stationary portion 18 is further increased, thereby, allowing a longer input media stack 24 to be used. Notably, upon sliding extension section 62 away from leading edge 72 of primary section 60, latch 86 engages latch stop 126. Interaction between latch 86 and latch stop 126 prevents extension section 62 from sliding off of primary section 60. As such, latch 86 and latch stop 126 maintain assembly of the entire rotatable portion 20. Notably, in the extended position, rotatable portion 20 extends a second length $L_2$ from stationary portion 18 and second length $L_2$ is greater than first length $L_1$.

In one embodiment, movement of extension section 62 with respect to primary section 60 is further limited by an additional latch assembly. In one particular embodiment, length adjuster 22 further includes a latch actuator 210 (illustrated in FIGS. 6 and 6A) and extension section 62 further includes an additional latch (not shown). In such an embodiment, the additional latch maintains leading edge 102 of extension section 62 in alignment with leading edge 72 of primary section 60 as length adjuster 22 moves along stationary track portion 42 and rotatable track portion 150. Only upon movement of length adjuster 22 to the trailing edge 104 of extension section 62 does latch actuator 210 interact with the additional latch triggering the additional latch to release extension section 62 with respect to primary section 60. As such, only upon movement of length actuator 22 to trailing edge 104, can extension section 62 be slid away from leading edge 72 of primary section 60. In one embodiment, movement of extension section 62 away from leading edge 72 of primary section 60 allows input tray 14 to properly receive relatively large print media, such as legal size paper, etc. In one embodiment, input tray 14 is capable of receiving print media having a length dimension of greater than 11.25 inches. In one embodiment, extended input tray 14 is adapted to receive print media of up to 14 inches in length. These dimensions may, of course, vary.

Figure 9:
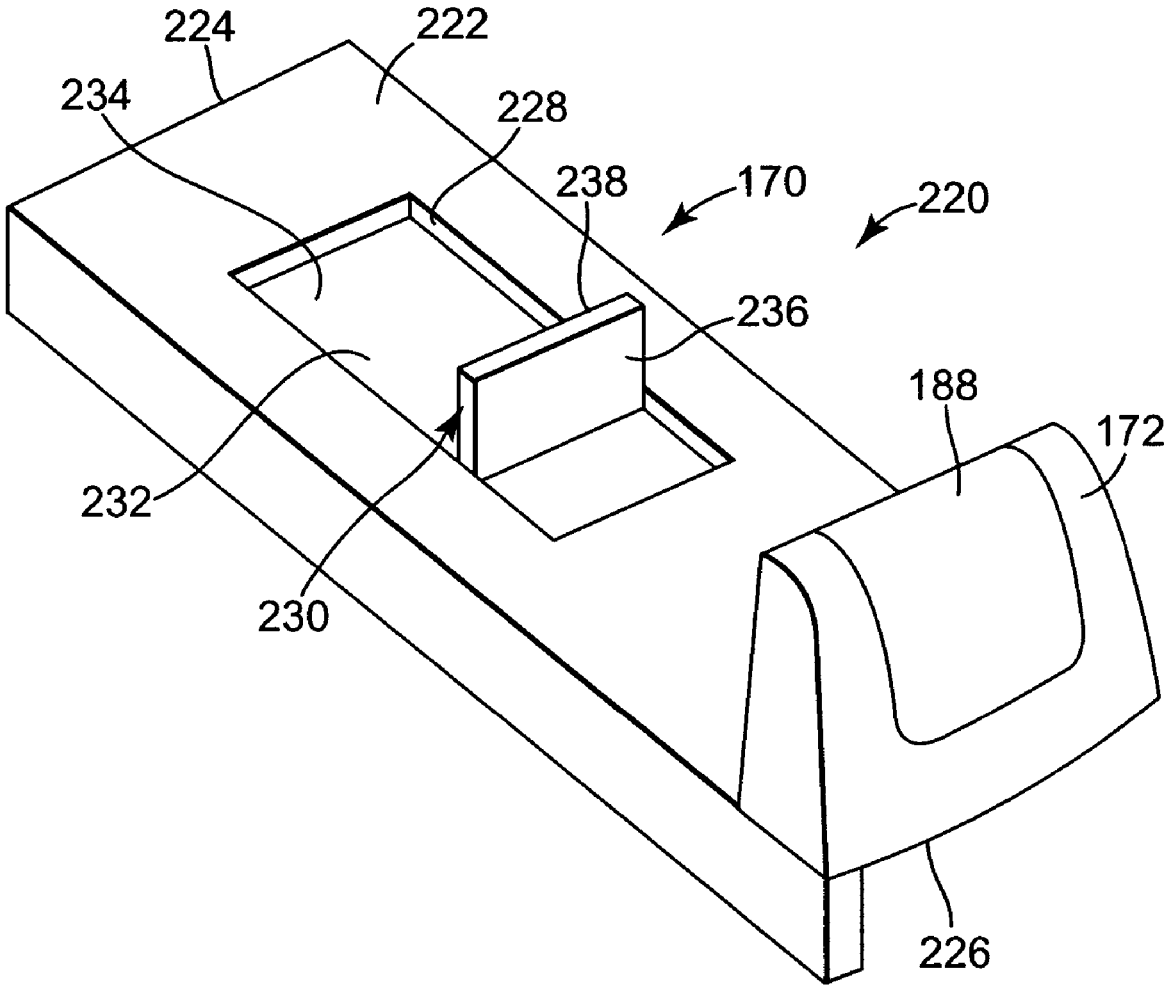
FIG. 9 illustrates another embodiment of a length adjuster for use with the rotatable media input tray illustrated in FIG. 3.

FIG. 9 illustrates one alternative embodiment of a length adjuster for use with length adjuster system generally at 220. Length adjuster 220 is similar to length adjuster 22 except for the differences specifically enumerated below. Length adjuster 220 includes track interface portion 170 and the media stop or handle 172 as described for length adjuster 220. Track interface portion 170 defines a first surface 222, a leading edge 224, and a trailing edge 226. First surface 222 is a substantially flat surface extending over the remaining track interface portion 170. Leading edge 224 is positioned opposite media stop 172, and trailing edge 226 is positioned near media stop 172. Secondary length adjuster 230 is slidably coupled with length adjuster 220 and accessible through an aperture 228 of first surface 222.

Secondary length adjuster 230 includes a connection portion 232, which defines an exterior surface 234, and a secondary media stop 236. Connection portion 232 is slidably coupled with length interface portion 170 such that secondary length adjuster 230 can be slidably adjusted along a longitudinal distance extending a portion of the distance between leading edge 224 and trailing edge 226. Secondary media stop 236 is rotatably connected to exterior surface 234. Secondary media stop 236 defines a leading or media interface surface 238 facing the input print media stack 24. In one embodiment, secondary media stop 236 is rotatably connected to the exterior surface 234 with a hinge (not shown) connected to the leading surface 238 of the secondary media stop 236 and the exterior surface 234, such that a pin (not shown) of the hinge serves as a rotational axis form the secondary media stop 236. In another embodiment, a rib (not shown) extends from the exterior surface 234 of the connection portion 232 terminating to define a circular end, and the secondary media stop 236 defines a circular groove (not shown) configured to rotatably receive the rib to form a snap fit connection. As such, the circular end of the rib defines the rotational axis of the secondary media stop 236. Other methods of rotatably connecting the secondary media stop 236 with the exterior surface 234 of the connection portion 232 will be apparent to those of ordinary skill in the art.

Secondary media stop 236 is adapted to function as a media stop for relatively short print media 24 (illustrated in FIG. 1) for which media stop 172 cannot be adjusted to reach. When utilizing secondary media stop 236, secondary media stop 236 extends upwardly from exterior surface 234 in a substantially perpendicular manner. When media stop 172 can sufficiently reach input media stack 24, secondary media stop 236 is rotated about its connection, more particularly, the rotational axis, with exterior surface 234 such that leading surface 238 is positioned on or near exterior surface 234. In one embodiment, secondary media stop 236 rotates to a position in which secondary media stop 236 is parallel with respect to exterior surface 234. In another embodiment, leading surface 238 of secondary media stop 236 rotates towards exterior surface 234 such that secondary media stop 236 is at least partially maintained within aperture 228. In one embodiment, secondary media stop 236 is rotated to be completely maintained within aperture 228 in order to decrease interference between the secondary media stop 236 and the input media stack 24.

Notably, length adjuster 220 can be incorporated with a rotatable media input tray incorporating only rotatable track portion 150, stationary track portion 42 and rotatable track portion 150 including extension section 62, stationary track portion 42 and rotatable track portion 150 without extension capabilities, or other variations of the rotatable input tray described above. Moreover, a rotatable media input tray utilizing length adjuster 22 or 220 may incorporate stationary track portion 42, an extending rotatable portion 20, or both.

Notably, in the embodiments described above length adjuster 22 or 220 is movable along an adjustable length. In particular, in the embodiment illustrated in FIG. 8, length adjuster 22 is moveable along an adjustable length equal to second length $L_2$ plus the length of stationary track portion 18. In one embodiment that does not incorporate a stationary track portion 18, the adjustable length would be equal to the second length $L_2$. In one embodiment that does not incorporate the extendable nature of rotatable portion 20, the adjustable length is equal to the first length $L_1$ (illustrated in FIGS. 3 and 7) and the length of the stationary track portion 18.

Some embodiments of a rotatable media input tray allows a length adjuster to be variably positioned to interact with a variety of print media sizes. In another embodiment, the length adjuster is adapted to interact with a print media stack having a length within the range of about 5 to 14 inches. As such, relatively large and/or relatively small print media can be fed into the printing mechanism for printing in a relatively reliable manner, in some embodiments. In particular embodiments, interaction of the length adjuster with the less common print media sizes facilitates proper maintenance of non-picked sheets within the rotatable input tray following imposition of a kicker force from the feed mechanism. By facilitating such maintenance, this rotatable media input tray may decrease multi-picking, paper stalls, paper jams, etc. that may otherwise occur with subsequent print media picks.

What is claimed is:

1. A printer system comprising:

a tray adapted for use with a printing mechanism, the tray comprising:

a stationary portion adapted to be coupled with the print mechanism, a rotatable portion rotatably coupled with and extending a first length from the stationary portion, and a length adjuster slidably coupled with the rotatable portion, the length adjuster being adapted to move along an adjustable length, the adjustable length being greater than the first length of the rotatable portion.

2. The system of claim 1, wherein the length adjuster is selectively and slidably coupled with the rotatable portion, and the length adjuster is also selectively and slidably coupled with the stationary portion.

3. The system of claim 1, wherein the rotatable portion includes:

a primary section rotatably coupled with and extending from the stationary portion; and an extension section slidably coupled to the primary section, the extension section being adapted to move between a nominal position and an extended position, in which the rotatable portion extends a second length from the stationary portion, the second length being greater than the first length.

4. The system of claim 3, wherein the length adjuster is selectively and slidably coupled to the extension section.

5. The system of claim 4, wherein the length adjuster slides in a direction parallel to the movement of the extension section between the nominal position and the extended position.

6. The system of claim 3, wherein movement of the extension section between the nominal and extended positions simultaneously moves the length adjuster along the adjustable length.

7. The system of claim 3, wherein the length adjuster also is selectively and slidably coupled with the stationary portion.

8. The system of claim 3, wherein the adjustable length is longer than the second length.

9. The system of claim 1, wherein the length adjuster includes a secondary length adjuster.

10. The system of claim 1, further comprising:

a second tray rotatably coupled with the print mechanism.

11. The system of claim 10, wherein the second tray is rotatably coupled with the print mechanism via the stationary portion.

12. An input tray for use with a printer, the input tray comprising:

a stationary portion;

a rotatable portion rotatably coupled with the stationary portion;

a track partially maintained by each of the stationary portion the rotatable portion including;

a primary section rotatably coupled with and extending from the stationary portion, and an extension section selectively coupled to the primary section the extension section being adapted to move between a nominal position, in which the rotatable portion extends a first length from the stationary portion, and an extended position, in which the rotatable portion extends a second length from the stationary portion, the second length being greater than the first length;

a track partially maintained by each of the stationary portion and the rotatable portion, wherein the track is at least partially defined by the extension section; and a length adjuster adapted to be slidably secured to the track.

13. The input tray of claim 12, wherein the track extends parallel to the movement of the extension section between the nominal position and the extended position.

14. The input tray of claim 12, wherein movement of the extension section between the nominal and extended positions simultaneously moves the length adjuster.

15. A printer system comprising:

a tray to selectively maintain print media, the tray comprising:

a stationary portion coupled to a print mechanism, a rotatable portion rotatably coupled with and extending a first length from the stationary portion, and a length adjuster slidably coupled with the rotatable portion, the length adjuster being adapted to move along an adjustable length, the adjustable length being greater than the first length of the rotatable portion; and wherein print media is advanced from the tray to the print mechanism.

16. The system of claim 15, further comprising a track partially maintained by each of the rotatably portion and the stationary portion, the length adjuster being slidably coupled with the track.

17. The system of claim 15, wherein the rotatable portion includes:

a primary section rotatably coupled with and extending from the stationary portion; and an extension section selectively coupled to the primary section, the extension section being adapted to move between a nominal position, in which the rotatable portion extends a first length from the stationary portion, and an extended position, in which the rotatable portion extends a second length from the stationary portion, the second length being greater than the first length.

18. The system of claim 17, further comprising a track at least partially maintained by the extension section, the length adjuster being slidably coupled with the track.

19. The system of claim 18, wherein the track extends parallel to the movement of the extension section between the nominal position and the extended position.

20. The system of claim 17, wherein the track is at least partially maintained by the stationary portion.

21. The system of claim 15, further comprising:

a second tray to selectively receive print media from the print mechanism, the second tray being rotatably coupled with the print mechanism.

22. The system of claim 15, further comprising:

a second tray to selectively receive print media from the print mechanism, the second tray being rotatably coupled with the stationary portion.

23. An input tray for use with a print system, the input tray comprising:

a stationary portion adapted to be coupled with the print mechanism;

a rotatable portion rotatably coupled with and extending a first length from the stationary portion;

a media stop adapted to facilitate maintenance of a media stack within the input tray; and means for selectively maintaining the media stop at a plurality of positions along an adjustable length to facilitate maintenance of the media stack having one of a plurality of lengths, wherein the adjustable length is greater than the first length, and wherein the plurality of positions includes positions other than positions along the first length.

24. The input tray of claim 23, wherein the plurality of length includes lengths in the range of 5 to 14 inches.

25. The input tray of claim 23, wherein the plurality of lengths includes lengths in which the media stack terminates on the stationary portion.

26. The input tray of claim 23, wherein the plurality of lengths includes lengths in which the media stack extends past the first length.

27. The input tray of claim 23, wherein the means for selectively maintaining is collectively defined by the stationary portion and the rotatable portion.

28. An tray for use with a printing mechanism, the tray comprising:

a stationary portion adapted to be coupled with the print mechanism, a rotatable portion rotatably coupled with and extending a first length from the stationary portion, and a length adjuster slidably coupled with the rotatable portion, the length adjuster being adapted to move along an adjustable length, the adjustable length being greater than the first length of the rotatable portion, the length adjuster including a secondary length adjuster.

29. The system of claim 28, wherein the length adjuster includes an interface portion coupled to the rotatable portion of the tray and a media stop extending from the interface portion and adapted to interact with a media stack, the secondary length adjuster being slidably coupled with the interface portion.

30. The system of claim 28, wherein the secondary length adjuster includes a rotatable, secondary media stop.

31. The system of claim 30, wherein the length adjuster includes a media stop, and the secondary media stop is adapted to interact with the media stack when the media stack is spaced away from the media stop.

32. A method of maintaining a print media stack in a tray, wherein the tray includes a stationary portion, a rotatable portion rotatably coupled with and extending a first length from the stationary portion, and a length adjuster adapted to facilitate maintenance of the media stack within the tray, the method comprising:

adjusting the position of the length adjuster along a track at least partially defined by the rotatable portion to facilitate maintenance of the print media stack having one of a plurality of lengths;

placing the print media stack into the tray, wherein the length adjuster is adapted to be positioned anywhere along an adjustable length, the adjustable length being longer than the first length of the rotatable portion.

33. The method of claim 32, wherein the rotatable portion includes a primary section rotatably coupled with and extending from the stationary portion, and an extension section selectively coupled with the primary section, wherein adjusting the position of the length adjuster includes moving the extension section between a nominal position, in which the rotatable portion extends the first length from the stationary portion, and an extended position, in which the rotatable portion extends a second length form the stationary portion, the second length being greater than the first length.

34. The method of claim 32, wherein the track is at least partially defined by the stationary portion, and adjusting the position of the length adjuster includes moving the length adjuster onto the part of the track defined by the stationary portion.

* * * * *